US011120954B2

(12) United States Patent
Zheng et al.

(10) Patent No.: US 11,120,954 B2
(45) Date of Patent: Sep. 14, 2021

(54) INTEGRATED SWITCH

(71) Applicant: KEDU ELECTRIC CO., LTD., Yueqing (CN)

(72) Inventors: Chunkai Zheng, Yueqing (CN); Ziping Li, Yueqing (CN); Bangran Huang, Yueqing (CN); Zhihao Chen, Yueqing (CN); Zhihai Zhang, Yueqing (CN)

(73) Assignee: KEDU ELECTRIC CO., LTD., Yueqing (CN)

( * ) Notice: Subject to any disclaimer, the term of this patent is extended or adjusted under 35 U.S.C. 154(b) by 0 days.

(21) Appl. No.: 16/860,170

(22) Filed: Apr. 28, 2020

(65) Prior Publication Data

US 2020/0373102 A1 Nov. 26, 2020

(30) Foreign Application Priority Data

May 23, 2019 (CN) ..... 2019104360649

(51) Int. Cl.
*H01H 9/30* (2006.01)
*H01H 1/00* (2006.01)
(Continued)

(52) U.S. Cl.
CPC ..... *H01H 9/30* (2013.01); *H01H 1/0036* (2013.01); *H01H 1/14* (2013.01); *H01H 1/36* (2013.01);
(Continued)

(58) Field of Classification Search
CPC ..... H01H 9/30; H01H 1/0036; H01H 1/14; H01H 1/36; H01H 1/5805; H01H 3/12;
(Continued)

(56) References Cited

U.S. PATENT DOCUMENTS

2009/0095609 A1* 4/2009 Ruff ..... H01H 1/40 200/329
2010/0236912 A1 9/2010 Anaya
(Continued)

FOREIGN PATENT DOCUMENTS

CN 108 155 037 A 6/2018
EP 2 423 930 A1 2/2012
(Continued)

OTHER PUBLICATIONS

Communication European Search Report dated Oct. 29, 2020 in connection with European Patent Application No. 20172186.7.
(Continued)

*Primary Examiner* — Ahmed M Saeed
(74) *Attorney, Agent, or Firm* — Amster, Rothstein & Ebenstein LLP

(57) ABSTRACT

An integrated switch is provided in the present application, comprising: a housing; a first circuit board, arranged in the housing; a movable stand, movably connected in the housing; a contact component; a second circuit board, arranged in the housing and connected with an inner wall thereof, and electrically connected with the first circuit board; an electric brush, arranged between the movable stand and the second circuit board, having one end connected with the movable stand and the other end slidably connected with the second circuit board, driven by the movable stand, the electric brush has a connection state after sliding to a first position of the second circuit board, and a disconnection state after sliding to a second position of the second circuit board, and the moving contact shifts from a power-on state to a power-off state after the electric brush slides to the disconnection state.

16 Claims, 4 Drawing Sheets

(51) Int. Cl.

| | |
|---|---|
| ***H01H 1/14*** | (2006.01) |
| ***H01H 1/36*** | (2006.01) |
| ***H01H 1/58*** | (2006.01) |
| ***H01H 3/12*** | (2006.01) |
| *H01H 9/04* | (2006.01) |

(52) U.S. Cl.
CPC ..... *H01H 1/5805* (2013.01); *H01H 3/12* (2013.01); *H01H 9/04* (2013.01)

(58) Field of Classification Search
CPC ..... H01H 9/04; H01H 15/005; H01H 13/14; H01H 13/66; H01H 13/18; H01H 15/107; H01H 13/10; H01H 15/06; H01H 15/10; H01H 1/365; H01H 15/04; H01H 2221/014; H01H 1/18; H01H 1/20; H01H 2025/048
See application file for complete search history.

(56) References Cited

U.S. PATENT DOCUMENTS

2016/0189886 A1* 6/2016 Terasawa ..... H01H 1/06 200/252
2016/0365202 A1* 12/2016 Koyama ..... B25F 5/00

FOREIGN PATENT DOCUMENTS

| | | | |
|---|---|---|---|
| EP | 2 637 258 | A2 | 9/2013 |
| WO | 2007009056 | A2 | 1/2007 |
| WO | 2018123223 | A1 | 7/2018 |

OTHER PUBLICATIONS

Communication Pursuant to Article 94(3) EPC dated Dec. 15, 2020 in connection with European Patent Application No. 20172186.7.

* cited by examiner

INTEGRATED SWITCH

CROSS REFERENCE

This application is based upon and claims priority to Chinese Patent Application No. 2019104360649, filed on May 23, 2019, titled "AN INTEGRATED SWITCH", and the entire contents of which are incorporated herein by reference.

TECHNICAL FIELD

The present application relates to the field of switch technology, and specifically to an integrated switch.

BACKGROUND

A microswitch is a contact mechanism with a micro contact interval and a fast-acting mechanism that performs switching operations with a specified stroke and a predetermined force. It is covered with a housing and has a drive lever on the outside.

The microswitch includes a housing, a movable stand, an elastic part, a lever, a moving contact, a circuit board, a movable contact frame, a static contact and a normally closed contact, a cavity is formed in the housing with the movable stand slidably installed therein, and part of the movable stand is partly exposed outside the housing, facilitating pressing the movable stand to make the movable stand slide in the cavity. The elastic part is installed between the movable stand and the bottom wall of the housing, for driving the reset of the movable stand. The circuit board is installed in the cavity and arranged on the bottom wall of the housing, the movable contact frame is installed in the cavity and connected to the circuit board, the lever has one end connected to the movable stand, and the other end abutting against the movable contact frame to fix the lever between the movable stand and the movable contact frame. The moving contact, which has one end fixedly connected with the lever and the other end connected with a moving contact point, is installed on the movable contact frame. Both the static contact and the normally closed contact are installed in the cavity, connected to the circuit board, and arranged opposite to each other. The moving contact is located between the static contact and the normally closed contact.

When the switch is in a free state, the moving contact is in contact with the normally closed contact. When the movable stand is pressed to move towards the bottom wall of the housing, one end of the moving contact near the movable stand moves downwards in synchronization with the lever, at this point, the end of the moving contact away from the movable stand moves in a direction away from the bottom wall of the housing, and the moving contact is always in contact with the normally closed contact. When the movable stand moves to the critical point where the elastic snap occurs, the end of the moving contact away from the movable stand changes the direction of movement under the action of the lever, the movable stand continues to move towards the bottom wall of the housing, and the end of the moving contact away from the movable stand moves towards the bottom wall of the housing, that is, the moving contact is separated from the normally closed contact, and as the movable stand continues to move towards the bottom wall of the housing, eventually the moving contact gets in electric contact with the static contact, the microswitch is turned on; when the external force applied to the movable stand vanishes, the movable stand is reset under the elastic force of the elastic part, meanwhile, the separation of the moving contact and the static contact causes the microswitch to be powered off. Electric arc which is generated when the moving contact is separated from the static contact can easily burn out the moving contact and the static contact, shortening the service life thereof, i.e., shortening the service life of the microswitch.

SUMMARY

Therefore, the technical problem to be solved by the present application is how to provide an integrated switch to overcome the deficiency of electric arcs generated when a moving contact and a static contact of a microswitch are detached in the prior art, leading to the shortening of the service life of the microswitch.

To solve the above technical problem, the present application provides an integrated switch, comprising:

a housing;

a first circuit board, arranged in the housing;

a movable stand, movably connected in the housing;

a contact component, arranged in the housing and electrically connected with the first circuit board, comprising a static contact and a moving contact connected with the movable stand, wherein, the moving contact has a power-off state when separated from the static contact and a power-on state when in contact with the static contact driven by the movable stand;

a second circuit board, arranged in the housing and connected with an inner wall thereof, and electrically connected with the first circuit board;

an electric brush, arranged between the movable stand and the second circuit board, having one end connected with the movable stand and the other end slidably connected with the second circuit board, driven by the movable stand, the electric brush has a connection state when connected with the first circuit board after sliding to a first position of the second circuit board, and a disconnection state when cut off from the first circuit board after sliding to a second position of the second circuit board, and the moving contact shifts from a power-on state to a power-off state after the electric brush slides to the disconnection state.

Optionally, the second circuit board comprises a plate body, and a first electrical conductor and a second electrical conductor mounted thereon, the first circuit board is respectively connected with the first electrical conductor and the second electrical conductor, the first electrical conductor and the second electrical conductor on the plate body are spaced apart and arranged in parallel along a moving direction of the movable stand, when the electric brush is on the first position of the second circuit board, the electric brush is connected with both the first electrical conductor and the second electrical conductor, and when the electric brush is on the second position of the second circuit board, the electric brush is connected with the first electrical conductor and disconnected with the second electrical conductor.

Optionally, the second circuit board further comprises a third electrical conductor mounted on the plate body, along the moving direction of the movable stand, the third electrical conductor and the first electrical conductor on the plate body are spaced apart and arranged in parallel, and the third electrical conductor and the second electrical conductor are spaced apart and arranged in parallel, when the electric brush is on the second position of the second circuit board, the electric brush is connected with both the first electrical conductor and the third electrical conductor and not connected with the second electrical conductor.

Optionally, length directions of the first electrical conductor, the second electrical conductor and the third electrical conductor are the same as the moving direction of the movable stand.

Optionally, a side face of the first electrical conductor near the first circuit board is even with a side face of the second electrical conductor near the first circuit board, and a side face of the first electrical conductor away from the first circuit board is even with a side face of the third electrical conductor away from the first circuit board.

Optionally, the integrated switch further comprises at least two electrical connectors, some of the electrical connectors are respectively connected with the first electrical conductor and the first circuit board, and the remaining ones of the electrical connectors are respectively connected with the second electrical conductor and the first circuit board, and the electrical connector connected with the first electrical conductor is spaced apart from the electrical connector connected with the second electrical conductor.

Optionally, the electrical connector is an elastic part.

Optionally, a distance between the end of the first electrical conductor near the first circuit board and the first circuit board is smaller than a length of the elastic part in free state, and a distance between the end of the second electrical conductor near the first circuit board and the first circuit board is smaller than a length of the elastic part in free state.

Optionally, some of the elastic parts are respectively fixedly connected with the first electrical conductor and the first circuit board, and the remaining ones of the elastic parts are respectively fixedly connected with the second electrical conductor and the first circuit board.

Optionally, the electrical connector comprises two electrical connectors, spaced apart, one of which is respectively connected with the first electrical conductor and the first circuit board, and the other of which is respectively connected with the second electrical conductor and the first circuit board.

The technical solution of the present application has the following advantages:

1. The integrated switch provided by the present application comprises a housing, and a first circuit board, a movable stand, a contact component, a second circuit board and an electric brush which are all arranged in the housing, the movable stand is movably connected in the housing, the first circuit board is respectively and electrically connected with the contact component and the second circuit board, the second circuit board is connected with an inner wall of the housing to be fixed; the contact component comprises a static contact and a moving contact connected with the movable stand, when the movable stand moves in the housing under the action of external force, one end of the moving contact near the movable stand conducts synchronous movement along with the movable stand, causing one end of the moving contact away from the movable stand to have a power-off state when separated from the static contact and a power-on state when in contact with the static contact.

An electric brush is arranged between the movable stand and the second circuit board and has one end connected with the movable stand and the other end slidably connected with the second circuit board, driven by the movable stand, when the movable stand moves in the housing under the action of external force, the electric brush moves synchronously with the movable stand, and the electric brush slides relative to the second circuit board, and has a connection state when connected with the first circuit board via the second circuit board after sliding to a first position of the second circuit board, and has a disconnection state when cut off from the first circuit board after sliding to a second position of the second circuit board, and the electric brush is unable to be connected with the first circuit board via the second circuit board. Moreover, the moving contact shifts from a power-on state to a power-off state only when the electric brush is in the disconnection state. In other words, when the moving contact is in the power-on state and the electric brush is in the connection state, and the movable stand moves in the opposite direction with the vanishing of the forces imposed thereon, the movable stand first drives the electric brush to slide from the first position to the second position of the second circuit board, enabling the electric brush to be cut off from the second circuit board, then the circuit in the integrated switch is cut off, and after the movable stand drives the electric brush to slide continuously relative to the second circuit board, the movable stand drives the end of the moving contact away from the movable stand to move from the static contact to the normally closed contact, and during this process, the moving contact is separated from the static contact before getting in contact with the normally closed contact.

Because the circuit in the integrated switch has been cut off via the electric brush when the moving contact is separated from the static contact, the moving contact is not electrically connected with the static contact, avoiding of generation of electric arc when the moving contact is separated from the static contact, thus protecting the moving contact and the static contact from being damaged by the electric arc, and prolonging the service life of the integrated switch.

In the prior art, the second circuit board is usually arranged outside the microswitch, causing the components on the second circuit board to be exposed, leading to the tendency of accumulation of dust and thus low dust-proof performance of the components, and the components are ready to be touched and tend to drop off. In the present application, the second circuit board is arranged in the housing, preventing exposure of the components thereon, improving the dustproof performance of the second circuit board, and the components on the second circuit board are prevented from falling due to being touched.

2. In the integrated switch provided by the present application, the second circuit board comprises a plate body, and a first electrical conductor and a second electrical conductor mounted thereon, the first circuit board is respectively connected with the first electrical conductor and the second electrical conductor, so that when the integrated switch is connected with power, the first circuit board is respectively and electrically connected with the first electrical conductor and the second electrical conductor. The first electrical conductor and the second electrical conductor on the plate body are spaced apart and arranged in parallel along a moving direction of the movable stand, when the electric brush is on the first position of the second circuit board, the electric brush is connected with both the first electrical conductor and the second electrical conductor, at this point, the electric brush, the first electrical conductor and the second electrical conductor form a closed loop with the first circuit board, so that the integrated switch is connected with power; and when the electric brush is on the second position of the second circuit board, the electric brush is connected with the first electrical conductor and disconnected with the second electrical conductor, at this point, the electric brush is not connected with the second electrical conductor, one end of the electric brush slides relative to the first electrical conductor while the other end slides relative to the surface of the plate body which is not electrically conductive, so that the electric brush, the first electrical conductor, and the second electrical conductor are not able to form a closed loop with the first circuit board therebetween, causing the integrated switch to be electrically disconnected.

3. In the integrated switch provided by the present application, the second circuit board further comprises a third electrical conductor mounted on the plate body, along the moving direction of the movable stand, the third electrical conductor and the first electrical conductor on the plate body are spaced apart and arranged in parallel, and the third electrical conductor and the second electrical conductor are spaced apart and arranged in parallel, when the electric brush is on the second position of the second circuit board, the electric brush is connected with both the first electrical conductor and the third electrical conductor and not connected with the second electrical conductor. At this point, since the second electrical conductor is spaced apart from the third electrical conductor, the first electrical conductor, the second electrical conductor, the third electrical conductor, the electric brush and the first circuit board are not able to form a closed loop, allowing the integrated switch to be electrically disconnected.

The additional arrangement of the third electrical conductor on the plate body allows the electric brush to slide relative to the first electrical conductor and the third electrical conductor when the electric brush is on the second position on the second circuit board, and due to the fact that the first electrical conductor, the second electrical conductor and the third electrical conductor have more desirable surface smoothness than that of the plate body, the friction of the electric brush can be reduced and thus the wearing can be reduced and the service life of the electric brush can be prolonged.

4. In the integrated switch provided by the present application, a side face of the first electrical conductor near the first circuit board is even with a side face of the second electrical conductor near the first circuit board, which can increase the distance over which the electric brush is simultaneously connected with the first electrical conductor and the second electrical conductor, making sure that the electric brush can be controlled to connect the switch with power. A side face of the first electrical conductor away from the first circuit board is even with a side face of the third electrical conductor away from the first circuit board, which can increase the distance over which electric brush is simultaneously connected with the first electrical conductor and the third electrical conductor, reducing the wearing of the electric brush, and prolonging the service life thereof.

5. The integrated switch provided by the present application further comprises at least two electrical connectors, a part of which is respectively connected with the first electrical conductor and the first circuit board, enabling the first electrical conductor to be electrically connected with the first circuit board via the electrical connector, and the other part of which is respectively connected with the second electrical conductor and the first circuit board, enabling the second electrical conductor to be electrically connected with the first circuit board through the other part of the electrical connector, and the electrical connector connected with the first electrical conductor is spaced apart from the electrical connector connected with the second electrical conductor, preventing short circuit caused by contact between the electrical connectors.

6. In the integrated switch provided by the present application, the electrical connector is an elastic part, which has a certain buffering damping effect when the switch is impacted, which can prevent the elastic part from being separated from the first electrical conductor, the second electrical conductor or the first circuit board, and improve the strength of connection between the elastic part and the first electrical conductor, the second electrical conductor or the first circuit board.

7. In the integrated switch provided by the present application, a free state of the elastic part refers to a state where the elastic part is neither compressed nor stretched, and the distance between one end of the first electrical conductor near the first circuit board and the first circuit board is smaller than the length of the elastic part in the free state, in other words, the elastic part is in a compressed state when it is located between the first electrical conductor and the first circuit board, and the distance between one end of the second electrical conductor near the first circuit board and the first circuit board is smaller than the length of the elastic part in the free state, in other words, the elastic part is in a compressed state when it is located between the second electrical conductor and the first circuit board, thus further improving the damping effect of the elastic part, and the strength of connection between the elastic part and first electrical conductor, the second electrical conductor or and the first circuit board.

8. In the integrated switch provided by the present application, a part of the elastic part is respectively fixedly connected with the first electrical conductor and the first circuit board, and the other part of the elastic part is respectively fixedly connected with the second electrical conductor and the first circuit board, further increasing the damping effect of the elastic part. When the integrated switch is subjected to vibration, the vibration can be buffered by compression and stretching of the elastic part, thus improving the strength of connection between the elastic part and the first electrical conductor, the second electrical conductor, and the first circuit board.

BRIEF DESCRIPTION OF THE DRAWINGS

In order to make a clearer description of technical solutions in specific implementations of the present application or prior art, drawings involved in description for the specific implementations or the prior art will be briefly introduced, and apparently, the drawings described below illustrate some implementations of the present application, for one with ordinary skill in the art, other drawings can also be obtained in accordance with these drawings without delivering creative efforts.

DESCRIPTION FOR REFERENCE NUMERALS

Figure 1:
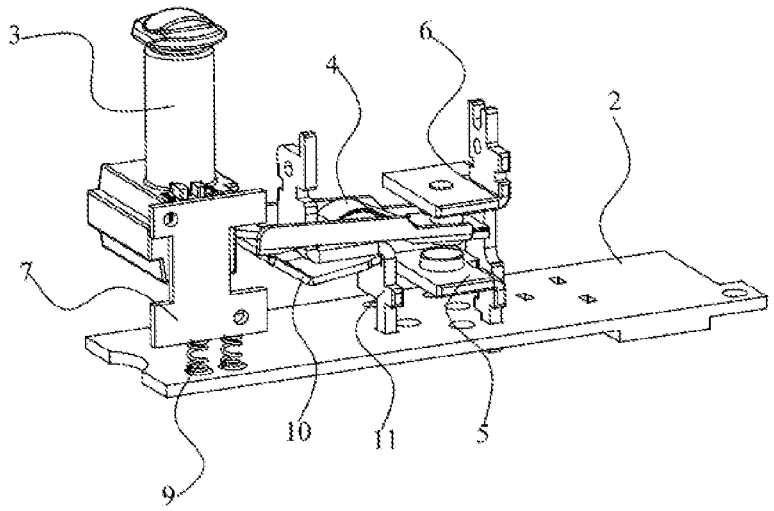
FIG. 1 is a schematic view of part of an integrated switch provided in one embodiment of the present application.
Figure 2:
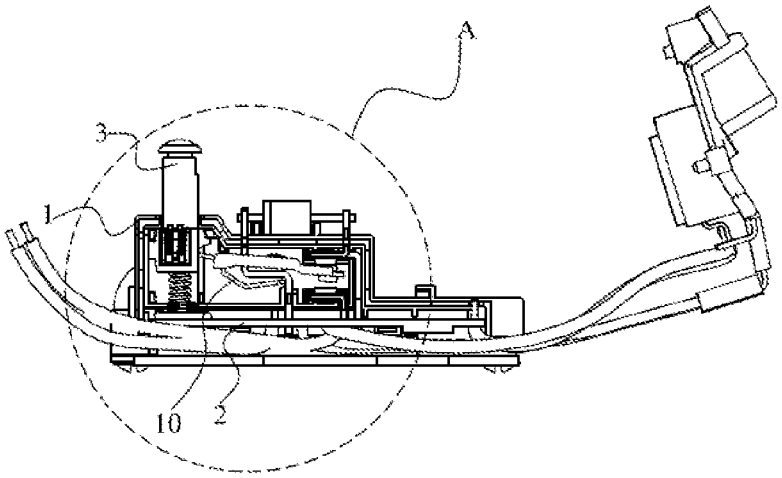
FIG. 2 is a schematic view of the interior of a contact component in a power-off state of an integrated switch provided in one embodiment of the present application.

1. housing; 2. first circuit board; 3. movable stand; 4. moving contact; 5. static contact; 6. normally closed contact;

7. second circuit board; 71. plate body; 72. first electrical conductor; 73. second electrical conductor; 74. third electrical conductor; 8. electric brush; 9. electrical connector; 10. lever; 11. movable contact frame.

DETAILED DESCRIPTION OF EMBODIMENT

Technical solutions of the present application will be described clearly and completely as follows in conjunction with the drawings, apparently, the described embodiments are just part rather than all embodiments of the present application. Based on the embodiments in the present application, all other embodiments obtained by one with ordinary skill in the art without delivering creative efforts shall fall into the protection scope of the present application.

In the description of the present application, it should be noted that, orientation or position relationships indicated by terms such as "centre", "upper", "lower", "left", "right", "vertical", "horizontal", "inner", "outer", etc. are orientation or position relationships indicated on the basis of the accompanying drawings, are only intended to facilitate description or simplified description of the present application, rather than indicating or implying that the involved apparatus or element shall have specific orientations, or be configured and operated specifically, and therefore shall not be construed as limitations to the present application. In addition, terms such as "first", "second", "third", which are merely intended to deliver description, can not be construed as indicating or implying relative importance.

In the description of the present application, it should be noted that, unless specified and defined otherwise, the terms of "installation", "interconnection" and "connection" shall be understood in a broad sense, for example, a fixed connection, a removable connection, an integral connection, a mechanical connection, an electrical connection, a direct connection, an indirect connection via intermediate medium, or further, internal communication between two elements. Case-by-case interpretation can be made to the above terms in the present application by one with ordinary skill in the art.

Moreover, technical features involved in different implementations described in the present application below may be combined with each other as long as no conflicts occur therebetween.

An integrated switch of the embodiments, as shown in FIG. 1 to FIG. 7, comprises a housing 1; a first circuit board 2, arranged in the housing 1; a movable stand 3, movably connected in the housing 1; a contact component, arranged in the housing 1 and electrically connected with the first circuit board 2, comprising a static contact 5 and a moving contact 4 connected with the movable stand 3, wherein, the moving contact 4 has a power-off state when separated from the static contact 5 and a power-on state when in contact with the static contact 5 driven by the movable stand 3. When the movable stand 3 moves in the housing 1 under the action of external force, one end of the moving contact 4 near the movable stand 3 conducts synchronous movement along with the movable stand 3, causing one end of the moving contact 4 away from the movable stand 3 to have a power-off state when separated from the static contact 5 and a power-on state when in contact with the static contact 5;

a second circuit board 7, arranged in the housing 1 and connected with an inner wall thereof, and electrically connected with the first circuit board 2. The position of the second circuit board 7 is fixed through connection of the second circuit board 7 with the inner wall of the housing 1, so as to fix the second circuit board 7 on the housing 1;

an electric brush 8, arranged between the movable stand 3 and the second circuit board 7, having one end connected with the movable stand 3 and the other end slidably connected with the second circuit board 7, driven by the movable stand 3, the electric brush 8 has a connection state when connected with the first circuit board after sliding to a first position of the second circuit board 7, and a disconnection state after sliding to a second position of the second circuit board, and the moving contact 4 shifts from a power-on state to a power-off state after the electric brush 8 slides to the disconnection state.

When the movable stand 3 moves in the housing 1 under the action of external force, the electric brush 8 moves synchronously with the movable stand 3, the electric brush 8 slides relative to the second circuit board 7 and has a connection state when connected with the first circuit board 2 via the second circuit board 7 after sliding to a first position of the second circuit board 7, and has a disconnection state when cut off from the first circuit board 2 after sliding to a second position of the second circuit board 7, and the electric brush 8 is unable to be connected with the first circuit board 2 via the second circuit board 7. Moreover, the moving contact 4 shifts from a power-on state to a power-off state only when the electric brush 8 is in the disconnection state. In other words, when the moving contact 4 is in the power-on state and the electric brush 8 is in the connection state, and the movable stand 3 moves in the opposite direction with the vanishing of the forces imposed thereon, the movable stand 3 first drives the electric brush 8 to slide from the first position to the second position of the second circuit board 7, enabling the electric brush 8 to be cut off from the second circuit board 7, then the circuit in the integrated switch is cut off, and after the movable stand 3 drives the electric brush 8 to slide continuously relative to the second circuit board 7, the movable stand 7 drives the end of the moving contact 4 away from the movable stand 3 to move from the static contact 5 to the normally closed contact 6, and during this process, the moving contact 4 is separated from the static contact 5 before getting in contact with the normally closed contact 6.

Because the circuit in the integrated switch has been cut off via the electric brush 8 when the moving contact 4 is separated from the static contact 5, the moving contact 4 is not electrically connected with the static contact 5, avoiding of generation of electric arc when the moving contact 4 is separated from the static contact 5, thus protecting the moving contact 4 and the static contact 5 from being damaged by the electric arc, and prolonging the service life of the integrated switch.

In the prior art, the second circuit board 7 is usually arranged outside the microswitch, causing the components on the second circuit board to be exposed, leading to the tendency of accumulation of dust and thus low dust-proof performance of the components, and the components are ready to be touched and tend to drop off. In the present application, the second circuit board 7 is arranged in the housing 1, avoiding of exposure of the components thereon, improving the dustproof performance of the second circuit board, and the components on the second circuit board are prevented from falling due to touching.

Figure 3:
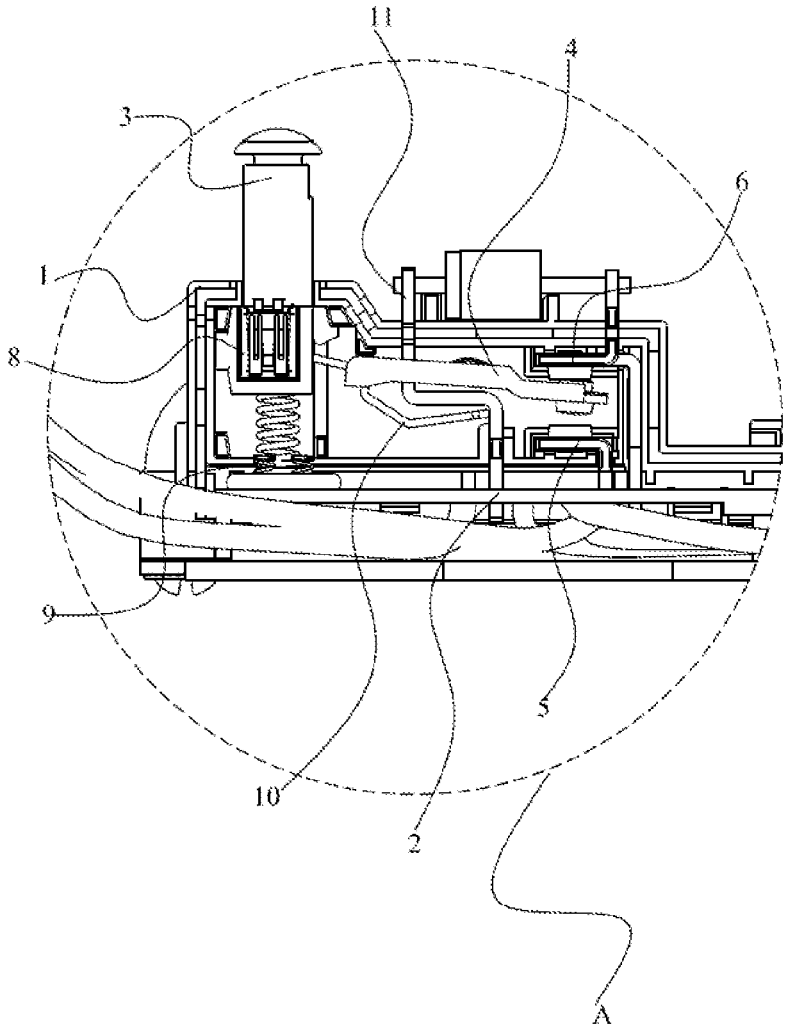
FIG. 3 is an enlarged view of A in FIG. 2.
Figure 4:
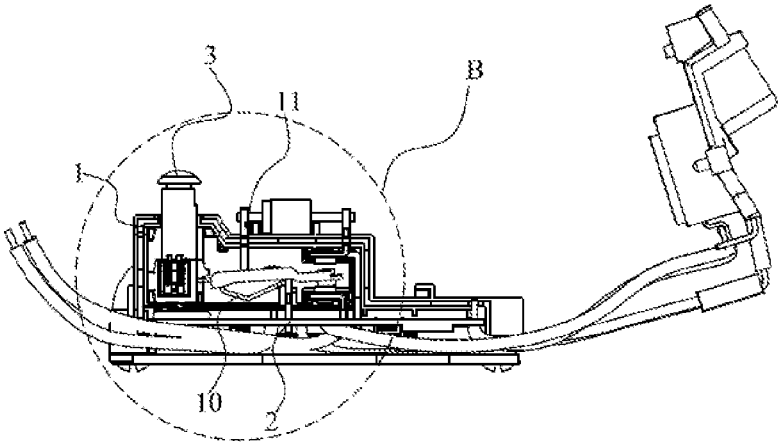
FIG. 4 is a schematic view of the interior of a contact component in a power-on state of an integrated switch provided in one embodiment of the present application.
Figure 5:
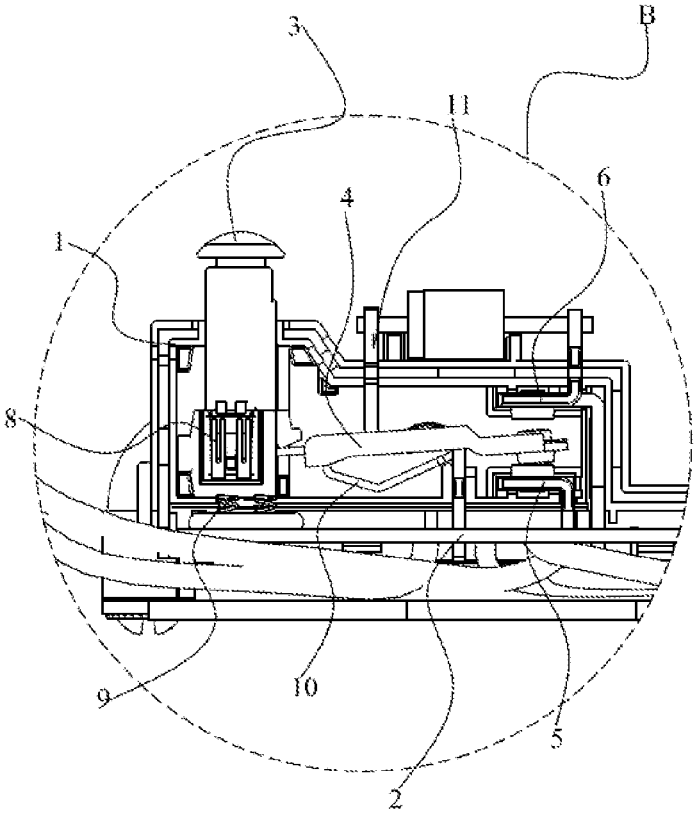
FIG. 5 is an enlarged view of part B in FIG. 4.

As shown in FIGS. 1, 3 and 5, the contact component further comprises a normally closed contact 6 arranged in the housing 1 and arranged opposite the static contact 5, the normally closed contact 6 is connected with the first circuit board 2 and has a normally closed contact arranged away from the first circuit board 2. A static contact on the static contact 5 is arranged near the first circuit board 2, and a moving contact on the moving contact 4 is arranged between the static contact and the normally closed contact. Before the movable stand 3 starts to move, the moving contact 4 is in contact with the normally closed contact 6, as the movable stand 3 moves, the moving contact 4 is separated from the normally closed contact 6 and gets in contact with the static contact 5, when the movable stand 3 moves in an opposite direction, the moving contact 4 is gradually separated from the static contact 5 before finally getting in contact with the normally closed contact 6 again.

Figure 6:
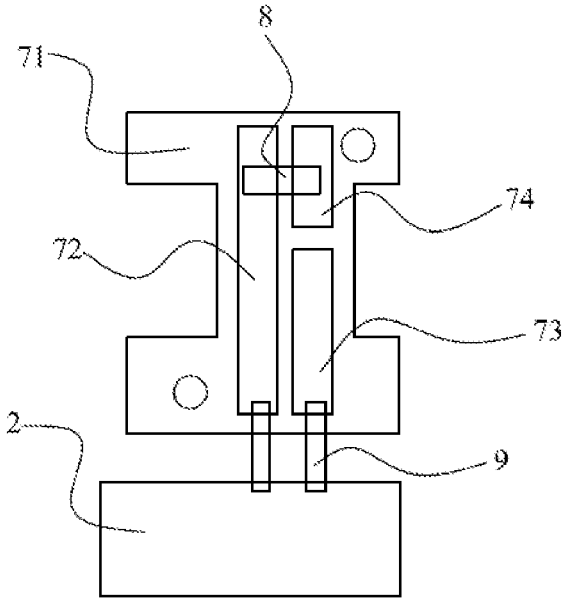
FIG. 6 is a schematic view of an electric brush of an integrated switch in a disconnection state provided in the specific implementation of the present application.
Figure 7:
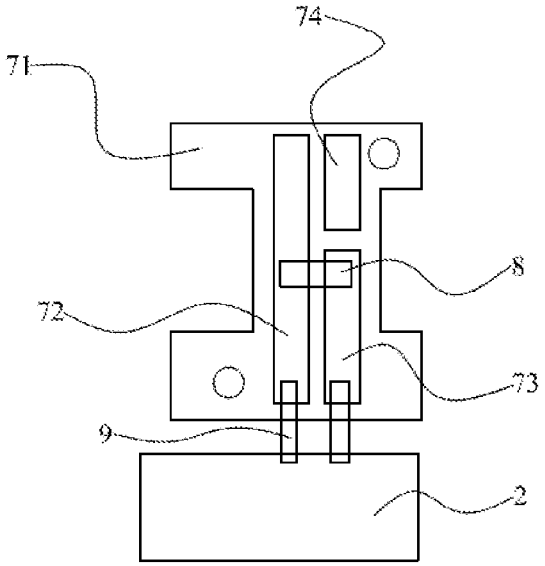
FIG. 7 is a schematic view of an electric brush of an integrated switch in a connection state provided in the specific implementation of the present application.

As shown in FIGS. 6 and 7, the second circuit board 7 comprises a plate body 71, and a first electrical conductor 72 and a second electrical conductor 73 mounted thereon, the first circuit board 2 is respectively connected with the first electrical conductor 72 and the second electrical conductor 73, so that the first circuit board 2 is respectively and electrically connected with the first electrical conductor 72 and the second electrical conductor 73 when the integrated switch is connected with power.

Along the moving direction of the movable stand 3, the third electrical conductor 72 and the first electrical conductor 73 on the plate body 71 are spaced apart and arranged in parallel, when the electric brush 8 is on the first position of the second circuit board 7, the electric brush 8 is connected with both the first electrical conductor 72 and the second electrical conductor 73, at this point, the electric brush 8, the first electrical conductor 72 and the second electrical conductor 73 form a closed loop with the first circuit board 2, so that the integrated switch is connected with power; and when the electric brush 8 is on the second position of the second circuit board 7, the electric brush 8 is connected with the first electrical conductor 72 and disconnected with the second electrical conductor 73, at this point, the electric brush 8 is not connected with the second electrical conductor 73, one end of the electric brush 8 slides relative to the first electrical conductor 72 while the other end slides relative to the surface of the plate body 72 which is not electrically conductive, so that the electric brush 8, the first electrical conductor 72, and the second electrical conductor 73 is not able to form a closed loop with the first circuit board 2 therebetween, causing the integrated switch to be electrically disconnected.

As shown in FIGS. 6 and 7, the second circuit board 7 further comprises a third electrical conductor 74 mounted on the plate body 71, along the moving direction of the movable stand 3, the third electrical conductor 74 and the first electrical conductor 72 on the plate body are spaced apart and arranged in parallel, and the third electrical conductor 74 and the second electrical conductor 73 are spaced apart and arranged in parallel, when the electric brush 8 is on the second position of the second circuit board 7, the electric brush 8 is connected with both the first electrical conductor 72 and the third electrical conductor 74 and not connected with the second electrical conductor 73. At this point, since the second electrical conductor 73 is spaced apart from the third electrical conductor 74, the first electrical conductor 72, the second electrical conductor 73, the third electrical conductor 74, the electric brush 8 and the first circuit board 2 are not able to form a closed loop, allowing the integrated switch to be electrically disconnected.

The additional arrangement of the third electrical conductor 74 on the plate body 71 allows the electric brush 8 to slide relative to the first electrical conductor 72 and the third electrical conductor 74 when the electric brush is on the second position on the second circuit board 7, and due to the fact that the first electrical conductor 72, the second electrical conductor 73 and the third electrical conductor 74 have more desirable surface smoothness than that of the plate body 71, the friction of the electric brush 8 is reduced and thus the wearing can be reduced and the service life of the electric brush can be prolonged.

As shown in FIGS. 6 and 7, a length direction of the first electrical conductor 72, the second electrical conductor 73 and the third electrical conductor 74 is the same as the moving direction of the movable stand 3. In this way, it can guarantee that the first electrical conductor 72, the second electrical conductor 73, and the third electrical conductor 74 are constantly in effective contact with the electric brush 8 along the moving direction of the movable stand 3, and the circuit will not be switched on again and off again.

As shown in FIGS. 6 and 7, a side face of the first electrical conductor 72 near the first circuit board 2 is even with a side face of the second electrical conductor 73 near the first circuit board 2, which can increase the distance over which the electric brush 8 is simultaneously connected with the first electrical conductor 72 and the second electrical conductor 73, making sure that the electric brush 8 can be controlled to connect the switch with power.

As shown in FIGS. 6 and 7, a side face of the first electrical conductor 72 away from the first circuit board 2 is even with a side face of the third electrical conductor 74 away from the first circuit board 2, which can increase the distance over which electric brush 8 is simultaneously connected with the first electrical conductor 72 and the third electrical conductor 74, thereby reducing the wearing of the electric brush 8 and prolonging the service life thereof.

As shown in FIGS. 1, 6 and 7, the integrated switch further comprises at least two electrical connectors 9, a part of which is respectively connected with the first electrical conductor 72 and the first circuit board 2, enabling the first electrical conductor 72 to be electrically connected with the first circuit board 2 via the electrical connector 9, and the other part of which is respectively connected with the second electrical conductor 73 and the first circuit board 2, enabling the second electrical conductor 73 to be electrically connected with the first circuit board 2 through the other part of the electrical connector 9, and the electrical connector 9 connected with the first electrical conductor 72 is spaced apart from the electrical connector 9 connected with the second electrical conductor 73, preventing short circuit caused by contact between the electrical connectors 9.

As shown in FIGS. 1, 6 and 7, the electrical connector 9 is an elastic part, which has a certain buffering damping effect when the switch is impacted, which can prevent the elastic part from being separated from the first electrical conductor 72, the second electrical conductor 73 or the first circuit board 2, and improve the strength of connection between the elastic part and the first electrical conductor 72, the second electrical conductor 73 or the first circuit board 2.

A distance between the end of the first electrical conductor 72 near the first circuit board 2 and the first circuit board 2 is smaller than a length of the elastic part in a free state, and a distance between the end of the second electrical conductor 73 near the first circuit board 2 and the first circuit board 2 is smaller than a length of the elastic part in free state.

The free state of the elastic part refers to a state where the elastic part is neither compressed nor stretched, and the distance between one end of the first electrical conductor 72 near the first circuit board 2 and the first circuit board 2 is smaller than the length of the elastic part in the free state, in other words, the elastic part is in a compressed state when it is located between the first electrical conductor 72 and the first circuit board 2, and the distance between one end of the second electrical conductor 73 near the first circuit board 2 and the first circuit board 2 is smaller than the length of the elastic part in the free state, in other words, the elastic part is in a compressed state when it is located between the second electrical conductor 73 and the first circuit board 2, thus further improving the damping effect of the elastic part, and the strength of connection between the elastic part and first electrical conductor 72, the second electrical conductor 73 or the first circuit board 2.

There is no restriction on the elastic part, any part that has elasticity and can realize electric connection can be used. For example, the elastic part can be a spring.

The free length of the electrical connector 9 between the end of second circuit board 7 near first circuit board 2 and the surface of the first circuit board 2 is greater than the distance between the end of the second circuit board 7 near the first circuit board 2 and the surface of the first circuit board 2, which can ensure that the elastic part is in the compressed state between the first circuit board 2 and the second circuit board 7 and further enhance the damping effect of the elastic part.

As shown in FIGS. 1, 6 and 7, a part of the elastic part is respectively fixedly connected with the first electrical conductor 72 and the first circuit board 2, and the other part of the elastic part is respectively fixedly connected with the second electrical conductor 73 and the first circuit board 2, further increasing the damping effect of the elastic part. When the integrated switch is subjected to vibration, the vibration can be buffered by compression and stretching of the elastic part, thus improving the strength of connection between the elastic part and the first electrical conductor 72, the second electrical conductor 73, or the first circuit board 2.

As shown in FIGS. 1, 6 and 7, the integrated switch is provided with two electrical connectors 9 which are spaced apart, one electrical connector 9 is respectively connected with the first electrical conductor 72 and the first circuit board 2, and the other electrical connector 9 is respectively connected with the second electrical conductor 73 and the first circuit board 2.

As shown in FIG. 1, the integrated switch comprises a lever 10 and a movable contact frame 11, the movable contact frame 11 is connected with the first circuit board 2, the moving contact 4 is mounted on the movable contact frame 11, and the end of the moving contact 4 near the movable stand 3 is connected with the lever 10, the lever 10 has one end connected with the movable stand 3 and the other end abutting against the movable contact frame 11, so as to fix the lever 10 between the movable stand 3 and the movable contact frame 11, when the lever 10 conducts synchronous movement along with the movable stand 3, the moving contact 4 also conducts synchronous movement along with the movable stand 3.

As shown in FIG. 3, the integrated switch further comprises a reset member which is located in the housing 1 and connected between the first circuit board 2 and the movable stand 3, for driving the reset of the movable stand 3. In the embodiment, the reset member may be a spring.

Working Principle of the Integrated Switch:

As shown in FIGS. 2 to 6, before the movable stand 3 moves, the moving contact 4 is in contact with the normally closed contact 6, the electric brush 8 on the movable stand 3 is connected with the first electrical conductor 72 and the third electrical conductor 74 on the second circuit board 7; when the movable stand 3 moves towards the first circuit board 2 under the action of external force, the reset member is compressed, and the movable stand 3 drives the electric brush 8, the lever 10 and the end of the moving contact 4 near the movable stand 3 to move synchronously towards the first circuit board 2, and the end of the moving contact 4 away from the movable stand 3 is still in contact with the normally closed contact 6, when the movable stand 3 moves to the critical point when the lever 10 undergoes elastic snap, the end of the moving contact 4 away from the movable stand 3 changes the direction of movement towards a direction towards the static contact 5, the movable stand 3 keeps moving towards the first circuit board 2, and the moving contact 4 gets in contact with the static contact 5, at this point, the electric brush 8 is still connected with the first electrical conductor 72 and the third electrical conductor 74, the movable stand 3 keeps moving towards the first circuit board 2, until the electric brush 8 is connected with the first electrical conductor 72 and the second electrical conductor 73, at this point, the electric brush 8 is connected with the third electrical conductor 74, the moving contact 4 is still in contact with the static contact 5, and integrated switch is connected with power.

When the external force on the movable stand 3 vanishes, and the movable stand 3 moves away from the first circuit board 2 under the elasticity of the reset member. The movable stand 3 drives the electric brush 8, the lever 10 and the end of the moving contact 4 near the movable stand 3 to move away from the first circuit board 2 simultaneously, the electric brush 8 slides relative to the second circuit board 7 and moves from being connected with the first electrical conductor 72 and the second electrical conductor 73 to being connected with the first electrical conductor 72 and the third electrical conductor 74 while not being connected with the second electrical conductor 73, at this point, the moving contact 4 is still in contact with the static contact 5, and the integrated switch is disconnected; the movable stand 3 continues to move away from first circuit board 2 to a snap critical point of the lever 10, the moving direction of the end of the moving contact 4 away from the movable stand 3 changes to a direction towards the normally closed contact 6, and then as movable stand 3 continues to move away from the first circuit board 2, the moving contact 4 is separated from the static contact 5, and finally the movable stand 3 drives the moving contact 4 to move to get in contact with the normally closed contact 6.

Obviously, the above embodiments are merely intended to clearly illustrate rather than limit the numerated implementations. For one with ordinary skill in the art, other different forms of modifications or changes may further be made on the basis of the aforementioned descriptions. It is unnecessary and impossible to exhaust all implementations. And modifications or changes derived herefrom obviously fall into the protection scope of the present application.

What is claimed is:

1. An integrated switch, comprising:

a housing;

a first circuit board, arranged in the housing;

a movable stand, movably connected in the housing;

a contact component, arranged in the housing and electrically connected with the first circuit board, comprising a static contact and a moving contact connected with the movable stand, wherein, the moving contact has a power-off state when separated from the static contact and a power-on state when in contact with the static contact driven by the movable stand;

a second circuit board, arranged in the housing and connected with an inner wall thereof, and electrically connected with the first circuit board; and an electric brush, arranged between the movable stand and the second circuit board, having one end connected with the movable stand and the other end slidably connected with the second circuit board, driven by the movable stand, wherein, the electric brush has a connection state when connected with the first circuit board after sliding to a first position of the second circuit board, and a disconnection state when cut off from the first circuit board after sliding to a second position of the second circuit board, and the moving contact shifts from a power-on state to a power-off state after the electric brush slides to the disconnection state, wherein, the second circuit board comprises a plate body, and a first electrical conductor and a second electrical conductor mounted thereon, the first circuit board is respectively connected with the first electrical conductor and the second electrical conductor, the first electrical conductor and the second electrical conductor on the plate body are spaced apart and arranged in parallel along a moving direction of the movable stand, when the electric brush is on a first position of the second circuit board, the electric brush is connected with both the first electrical conductor and the second electrical conductor, and when the electric brush is on a second position of the second circuit board, the electric brush is connected with the first electrical conductor and disconnected with the second electrical conductor.

2. The integrated switch according to claim 1, wherein, the second circuit board further comprises a third electrical conductor mounted on the plate body, along the moving direction of the movable stand, the third electrical conductor and the first electrical conductor on the plate body are spaced apart and arranged in parallel, and the third electrical conductor and the second electrical conductor are spaced apart and arranged in parallel, when the electric brush is on a second position of the second circuit board, the electric brush is connected with both the first electrical conductor and the third electrical conductor and not connected with the second electrical conductor.

3. The integrated switch according to claim 2, wherein, length directions of the first electrical conductor, the second electrical conductor and the third electrical conductor are the same as the moving direction of the movable stand.

4. The integrated switch according to claim 2, wherein, a side face of the first electrical conductor near the first circuit board is even with a side face of the second electrical conductor near the first circuit board, and a side face of the first electrical conductor away from the first circuit board is even with a side face of the third electrical conductor away from the first circuit board.

5. The integrated switch according to claim 2, further comprising at least two electrical connectors, some of the electrical connectors are respectively connected with the first electrical conductor and the first circuit board, and the remaining ones of the electrical connectors are respectively connected with the second electrical conductor and the first circuit board, and the electrical connector connected with the first electrical conductor is spaced apart from the electrical connector connected with the second electrical conductor.

6. The integrated switch according to claim 5, wherein, the electrical connector is an elastic part.

7. The integrated switch according to claim 6, wherein, a distance between the end of the first electrical conductor near the first circuit board and the first circuit board is smaller than a length of the elastic part in free state, and a distance between the end of the second electrical conductor near the first circuit board and the first circuit board is smaller than a length of the elastic part in free state.

8. The integrated switch according to claim 6, wherein, some of the elastic parts are respectively fixedly connected with the first electrical conductor and the first circuit board, and the remaining ones of the elastic parts are respectively fixedly connected with the second electrical conductor and the first circuit board.

9. The integrated switch according to claim 5, comprising two electrical connectors, spaced apart, one of which is respectively connected with the first electrical conductor and the first circuit board, and the other of which is respectively connected with the second electrical conductor and the first circuit board.

10. The integrated switch according to claim 3, wherein, a side face of the first electrical conductor near the first circuit board is even with a side face of the second electrical conductor near the first circuit board, and a side face of the first electrical conductor away from the first circuit board is even with a side face of the third electrical conductor away from the first circuit board.

11. The integrated switch according to claim 3, further comprising at least two electrical connectors, some of the electrical connectors are respectively connected with the first electrical conductor and the first circuit board, and the remaining ones of the electrical connectors are respectively connected with the second electrical conductor and the first circuit board, and the electrical connector connected with the first electrical conductor is spaced apart from the electrical connector connected with the second electrical conductor.

12. The integrated switch according to claim 4, further comprising at least two electrical connectors, some of the electrical connectors are respectively connected with the first electrical conductor and the first circuit board, and the remaining ones of the electrical connectors are respectively connected with the second electrical conductor and the first circuit board, and the electrical connector connected with the first electrical conductor is spaced apart from the electrical connector connected with the second electrical conductor.

13. The integrated switch according to claim 7, wherein, some of the elastic parts are respectively fixedly connected with the first electrical conductor and the first circuit board, and the remaining ones of the elastic parts are respectively fixedly connected with the second electrical conductor and the first circuit board.

14. The integrated switch according to claim 6, comprising two electrical connectors, spaced apart, one of which is respectively connected with the first electrical conductor and the first circuit board, and the other of which is respectively connected with the second electrical conductor and the first circuit board.

15. The integrated switch according to claim 7, comprising two electrical connectors, spaced apart, one of which is respectively connected with the first electrical conductor and the first circuit board, and the other of which is respectively connected with the second electrical conductor and the first circuit board.

16. The integrated switch according to claim 8, comprising two electrical connectors, spaced apart, one of which is respectively connected with the first electrical conductor and the first circuit board, and the other of which is respectively connected with the second electrical conductor and the first circuit board.

* * * * *